United States Patent [19]

Bubley

[11] Patent Number: 4,646,446

[45] Date of Patent: Mar. 3, 1987

[54] UV CURING APPARATUS

[75] Inventor: Henry J. Bubley, Deerfield, Ill.

[73] Assignee: American Screen Printing Equipment Company, Chicago, Ill.

[21] Appl. No.: 794,940

[22] Filed: Nov. 4, 1985

[51] Int. Cl.[4] ..... F26B 3/28

[52] U.S. Cl. ..... 34/4; 34/41

[58] Field of Search ..... 34/4, 41, 62, 232; 422/186.3

[56] References Cited

U.S. PATENT DOCUMENTS 3,187,162 6/1965 Hojo et al. ..... 34/41
4,336,279 6/1982 Metzger ..... 34/4
4,434,562 3/1984 Bubley et al. ..... 34/4
4,551,925 11/1985 Ericsson ..... 34/4

*Primary Examiner*—Henry C. Yuen
*Attorney, Agent, or Firm*—Fitch, Even, Tabin & Flannery

[57] ABSTRACT

An apparatus for the ultraviolet irradiating printed ink on sheet at a UV curing station is provided with a cooling station immediately downstream of the UV curing station. Air knives at the cooling station increase the air velocity and cause a turbulent air flow across the sheet to cool the same while a suction device beneath an air pervious conveyer for the sheet holds the sheet against fluttering at the curing station and at the cooling station.

5 Claims, 3 Drawing Figures

UV CURING APPARATUS

This invention relates to an ultraviolet light curing apparatus for curing ink which has been applied by a screen printing apparatus.

BACKGROUND OF THE INVENTION

U.S. Pat. No. 4,434,562 discloses an ultraviolet curing apparatus for curing U-V sensitive ink which has been applied to a substrate such as a sheet of paper or paperboard stock by a screen printing apparatus. The ink-bearing sheet is carried on a mesh conveyor through a housing in which is located at least one ultraviolet lamp which directs ultraviolet light to impinge on the ink on the upward side of the traveling sheet. The sheet is held down on the open mesh conveyor belt by means of a suction applied from a suction blower unit located beneath the belt. The suction applied also draws air through light baffles which are pervious to air. The suction forces hold the sheet flat against the mesh conveyor belt and against fluttering of otherwise flapping from the surface of the conveyor belt. The ultraviolet lamp generates considerable heat and a second air unit is used to blow air across both sides of the lamp's reflector shield to keep the temperature of the shield at a reasonable temperature. These UV lamps operate at a high temperature, i.e., 1,200° F. to 1,500° F. and the air cooling of inner and exterior sides of the reflector keeps it from becoming too hot. Also, the cooling air removes any harmful ozone generated during the curing process.

The ultraviolet reaction to cure the ink requires a certain amount of heat for its most effective operation. Therefore, it is not desired to cool the irradiation chamber and the sheet to too low a temperature. With the above-described patented apparatus using a 300 watts per inch ultraviolet lamp, the exit temperature of the sheet is generally in the range of 180° F. to 200° F. If the sheet temperature is allowed to be much higher than 200° F., the paper sheet stock may be adversely effected. Often, the sheets with cured ink are stacked in stacks while still warm. This occasions a build up of residual heat in the stack. If the sheets in the stack become too warm, they become limp, this results in the sheets being more difficult to handle with automated equipment.

The apparatus of U.S. Pat. No. 4,434,562 has been successful because it is small and compact in size and is low in cost while being highly effective in curing the UV ink and its handling of the sheets. It is most desireable that any cooling of the sheets for such an apparatus not be at the expense of making the curing apparatus so large or so expensive as to make it a noncommercially viable product.

The present invention is directed to providing a method and apparatus for ultraviolet curing of the sheets with an apparatus of the general type described above and having means for lowering the temperature of the sheets leaving the apparatus.

Accordingly, a general object of the present invention is to provide an ultraviolet curing apparatus having an open conveyor for carrying sheets beneath an ultraviolet lamp having an air cooled reflector and having an air cooling means for the sheets to lower the temperature of the sheets substantially after they exit the UV chamber.

A further object of the invention is to provide a new and improved system for cooling sheets with high velocity air before the sheets exit an ultraviolet curing apparatus and to holding the sheets down on the conveyor while high velocity turbulent air flows across the tops of the sheets.

These and other objects and advantages of the present invention will become apparent from the following detailed description taken in conjunction with the accompanying drawings.

DETAILED DESCRIPTION OF THE DRAWINGS

DETAILED DESCRIPTION OF THE PREFERRED EMBODIMENTS

Figure 1:
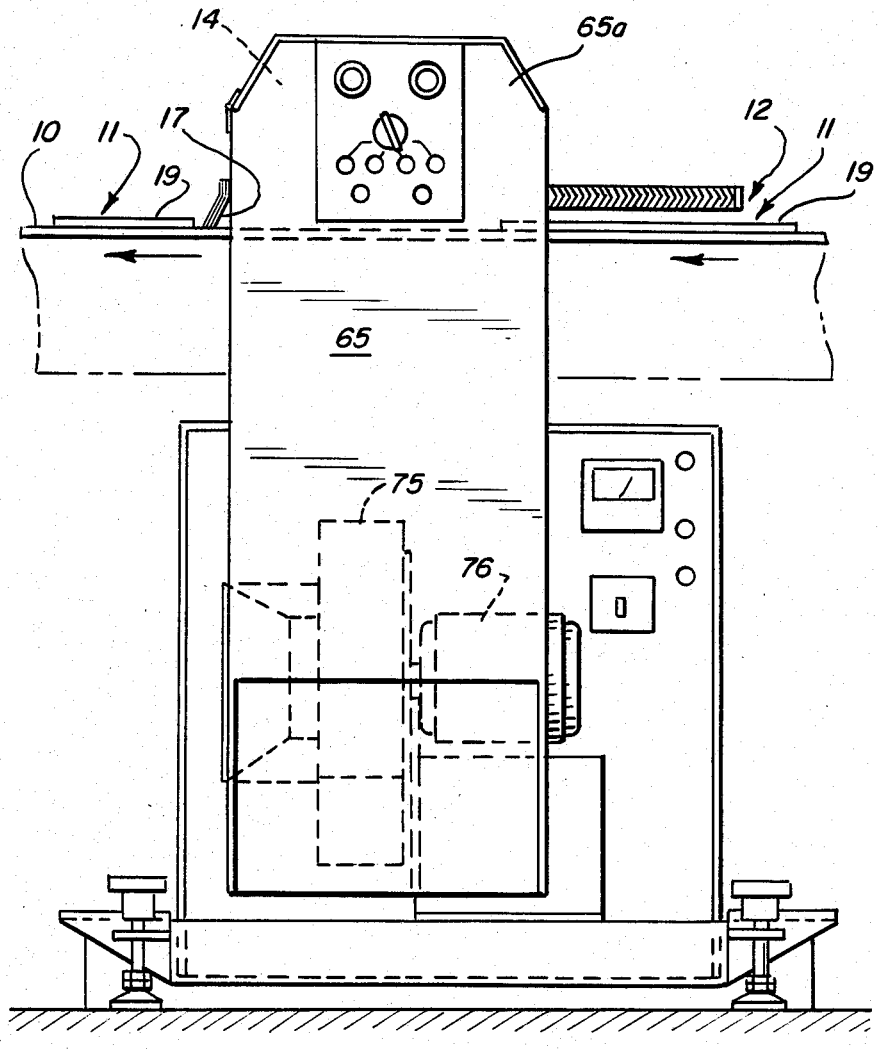
FIG. 1 is an end view of a curing apparatus constructed in accordance with a preferred embodiment of the invention.

As shown on the drawings for purposes of illustration, the invention is embodied in a curing apparatus preferably of the type disclosed in U.S. Pat. No. 4,434,562 in which conveying belt 10 carries a sheet 11 usually for continuous uninterrupted travel through an inlet opening 12 into the interior of a UV curing chamber 14 which is covered by an upper housing 15 within which is mounted a UV bulb 16. The preferred UV light bulb may generate as much as 300 watts per inch of light and operates at a high temperature, for example, 1200° or 1500° F. The UV bulb 16 is surrounded by an inverted reflector 18 which directs the light downwardly onto the upper surface of the open conveyor belt which is carrying the sheets with their upper surfaces 19 facing the UV curing lamp 16. The ink on these upper surfaces is irradiated by the UV light lamp 16 as the sheets continuously travel from the inlet 12 to an outlet 17 at the opposite downstream side of the housing 15.

Figure 3:
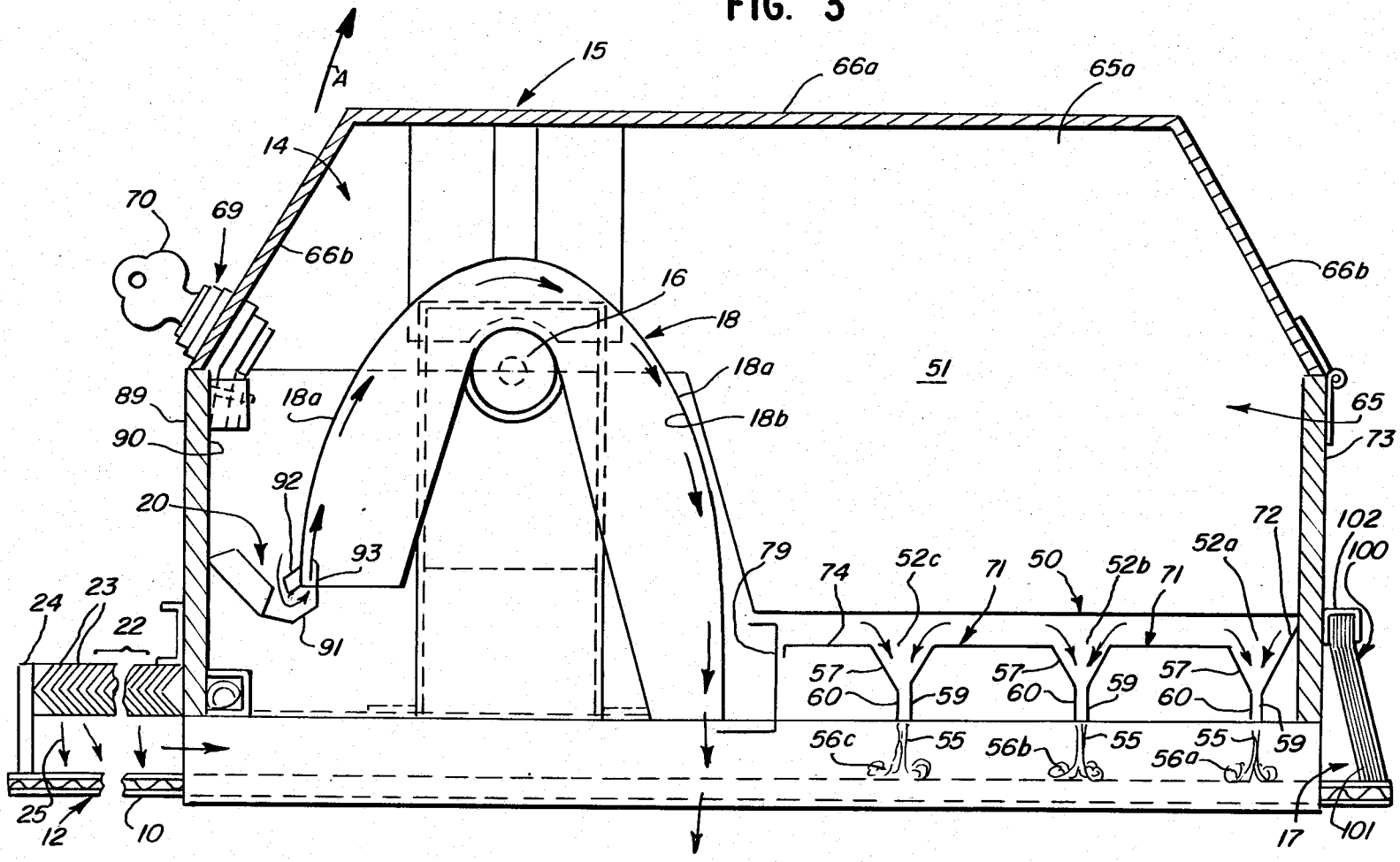
FIG. 3 is an enlarged cross sectional view taken substantially along the line 3—3 in FIG. 2.

As described in considerable detail in the aforementioned patent, cooling air is swept along an outer surface **18*a* of the reflector 18 as well as along and interior surface 18*b* so as to more effectively carry heat away from the reflector 18 to cool it to a reasonable temperature. As described in the patent, air is swept on both inner and outer sides 18 and 18*b* of the reflector 18 to cool the same; and the preferred manner to achieve this inner and outer cooling is to deflect air traveling down the left outside of reflector, as viewed in FIG. 3, by a deflector means 20 around the lower left edge of the reflect flow (as shown by the directional arrows in FIG. 3) upwardly and along the inner surface 18*b*** of the reflector to cool the same.

The sheets enter the housing 15 at the inlet 12 and pass beneath a light shield 22 thereat. The light shield 22 is preferably in the form of chevron shaped plates 23 mounted in a bracket 24 projecting over the conveyor belt.

The light shield 22 blocks the egress of UV light which is harmfull to human eyes if viewed. The chevron plates 23 serve as light traps by having the light bounce back and forth therein and preventing the light from exiting. Additionally, the chevron shaped light shield 22 is also air pervious allowing air to flow generally, as represented in F, lines 25 and against the top surface 19 of the sheet 11 on the mesh conveyor belt 10.

The apparatus disclosed in U.S. Pat. No. 4,434,562 had sheets which exit at the end of the housing at an outlet 40 at a temperature usually in the range of 180° to 200° F. In some instances the temperature of the sheet was actually higher than 200° F. While the heat at these high temperatures is found to be useful in curing the UV inks, the sheets exiting the conveyor belt 10 are often automatically stacked and there is a build up of residual heat within the stack because the sheets are at such a high temperature when stacked. This residual heat is deleterious to the rigidity of the sheets and may make them limp and difficult for subsequent handling by automated sheet feeding equipment.

In accordance with the present invention, the curing apparatus has been provided with a high velocity air cooling means 50 which delivers a turbulent flow of air across the surface of the sheet to remove heat therefrom in a quick and efficient manner. The preferred air cooling means delivers air in a turbulent state, i.e. flowing with a velocity higher than the Reynolds number across the surface 19 of the sheet 11 to increase the heat transfer and the removal of heat with room temperature air being delivered by the air cooling means 50. The preferred system provides high pressure room air into an air plenum 51 and the air means comprises air knives 52 which convert the large volume of high pressure air into high velocity jets or streams of air having a high velocity, e.g. of 1000 fpm. These high velocity air jets accomplishes the cooling of the sheets more quickly and in a smaller space than could be obtained otherwise, particularly from ambient air.

In accordance with the preferred embodiment of the invention, the high velocity cooling air, e.g., air at 1000 fpm, issues from a series of parallel air knives 52*a;* 52*b;* and 52*c* each of which has an elongated discharge slit or nozzle 55 for discharging air streams 56*a,* 56*b* and 56*c* directly against the upper surface 19 of a sheet 11 traveling therebeneath. By way of reference only, the width of the nozzles 55 may be as small as 1/16th of an inch and the air pressure in the plenum is sufficient to produce a very high velocity of air flow is achieved when the air is pulled down through the very narrow slots 55.

The high velocity air streams 56*a,* 56*b* and 56*c* flowing over the top surface 19 of the sheet 11 make an area of reduced pressure at the upper surface 19 and the sheet tends to lift and fly from the conveyor belt 10; but the sheets are held against such flying by the vacuum hold down achieved by a suction means which, in this instance, comprises a suction box 31 and suction blower 32 (FIG. 2) connected to the suction box to pull the sheet down tight against the conveyor belt.

The illustrated and preferred system uses three or four air knives 52 each of which has an upper tapered downwardly narrowing throat section 57 leading downwardly to its associated lower nozzle or slot 55 defined between a pair of parallel sheet metal walls 59 and 60 which are spaced 1/16th of an inch apart in this instance. High pressure air in the plenum accelerates and loses pressure as it flows through the throat section 57 and the slots 55 to discharge as jets each with a velocity above the Reynolds number, e.g., 1000 fpm, in this instance. In the illustrated invention, three jets 56*a,* 56*b,* and 56*c* strike the sheet at three longitudinally spaced positions as the sheet travels beneath the three nozzels 55 with each of the three jets having turbulent flow, as indicated at 58 in FIG. 3, across the transverse surface of the sheet. By way of example, sheets that exit at about 180° to 200° F. without the high velocity air means of the present invention have been found to have been cooled by the high velocity air jets to a temperature of about 125° F. At 125° F., the residual heat that the sheets bring to the stack of sheets is considerably lessened.

Referring now in greater detail to the preferred and illustrated embodiment of the invention, the illustrated air knives 55 are formed of sheet metal in the form of inverted panels (FIG. 2) which extend transversely across and above the lower edge of the housing 15 between transverse end walls 65 for the housing located on opposite sides of the conveyor belt 10 which travels between the end walls 65. The end walls are formed with angled corners 66*b* and a top horizontal side or edge 66*a*. The end walls 65 define the ends of the air plenum 51 and top cover 67 defines the top side of the air plenum. The overhead cover 67 engages the corners 66*b* and the top edge 66*a* of the end walls 65 and the cover is hinged at 68 for swinging movement as shown by the directional arrow "A" when the opposite end is unlocked by a key 70 in a latch and lock mechanism 69. The hinge 68 which may be in the form of a piano hinge extending transversely across the conveyor.

The air knives 52*a,* 52*b,* and 52*c* may be formed inexpensively by securing a plurality of sheet metal members at opposite ends thereof to the housing end walls 65. Herein, a pair of central inverted U-shaped members 71 are mounted to the end walls 65 with their respective slot defining walls 59 and 60 disposed parallel and vertical and spaced from each other to define the nozzles 55. At the outlet side of the apparatus an air knive end member 72 is secured to the outlet end housing wall 73. At the other end, an air knive end member 74 is extended in the conveyor upstream direction to a reflector support channel 79 which receives and supports a lower edge of the reflector 18 which may be lifted therefrom when changing the bulb 16.

The preferred means for supplying the air for the air knives is from a high pressure blower 75 which is driven by a motor 76. The blower has an outlet 77 connected to a flexible hose 78 which extends upwardly from the flower to a housing floor wall 80 (FIG. 2) at the one side of the unit. A housing sheet metal cover 81 covers this end of the unit and has the floor wall 80 connected to the discharge end of the flexible hose 78. Thus, through the floor wall 80 into one end of the plenum 51 and flows along the top surface of the reflector 18 to cool the outside of the reflector and also flows above the knives 52*a,* 52*b* and 52*c* with the air being pulled downwardly through the slots 55 and increasing in velocity as it moves through the funnel shaped throats 57 into the narrow nozzles slots 55.

Some of the air is deflected by the curved deflector means 20 to flow upward along the inside surface 18*b* of the reflector 18 to cool the same. The illustrated deflector 20 comprises a sheet metal guide having one end 90 attached to inlet side, upstanding housing wall 89. The deflector extends along the shield with a curved portion 91 (FIG. 3) of the deflector shield spaced beneath a curled edge 92 on the shield 18. An inwardly inclined, air discharge end 93 of the deflector is spaced by a small gap such as, for example ⅛ of an inch from the inner surface of the reflector to deliver air as upwardly directed jet of air directed to flow upwardly along the inner surface 18*b* of the reflector 18.

The illustrated UV bulb is mounted in support brackets 95 and 96 (FIG. 2) at opposite ends with the brackets being suitably supported by the housing. The bulb 18 extends the full transverse width of the conveyor belt so that all of the conveyor belt moving beneath the bulb is irradiated along with any sheets thereon.

While the inlet end 12 to the housing 15 has a light shield 22 with the chevron shaped plates 23, an outlet end light shield may be in the form of a brush 100 to provide a light shield which is less expensive and of a reduced width in the direction of conveyor travel. Herein, the brush has bristles 101 with lower ends brushing over the top of any sheet going therebeneath. Since the ink has already been cured the bristles will not smear any ink. The brush 100 is mounted in a brush holder 102 which is secured in the housing outlet wall 73. Because of the space occupied by the air knives, the brush 100 is distanced sufficiently far from the bulb 16 that UV light will not be seen or reflected through the brush.

Figure 2:
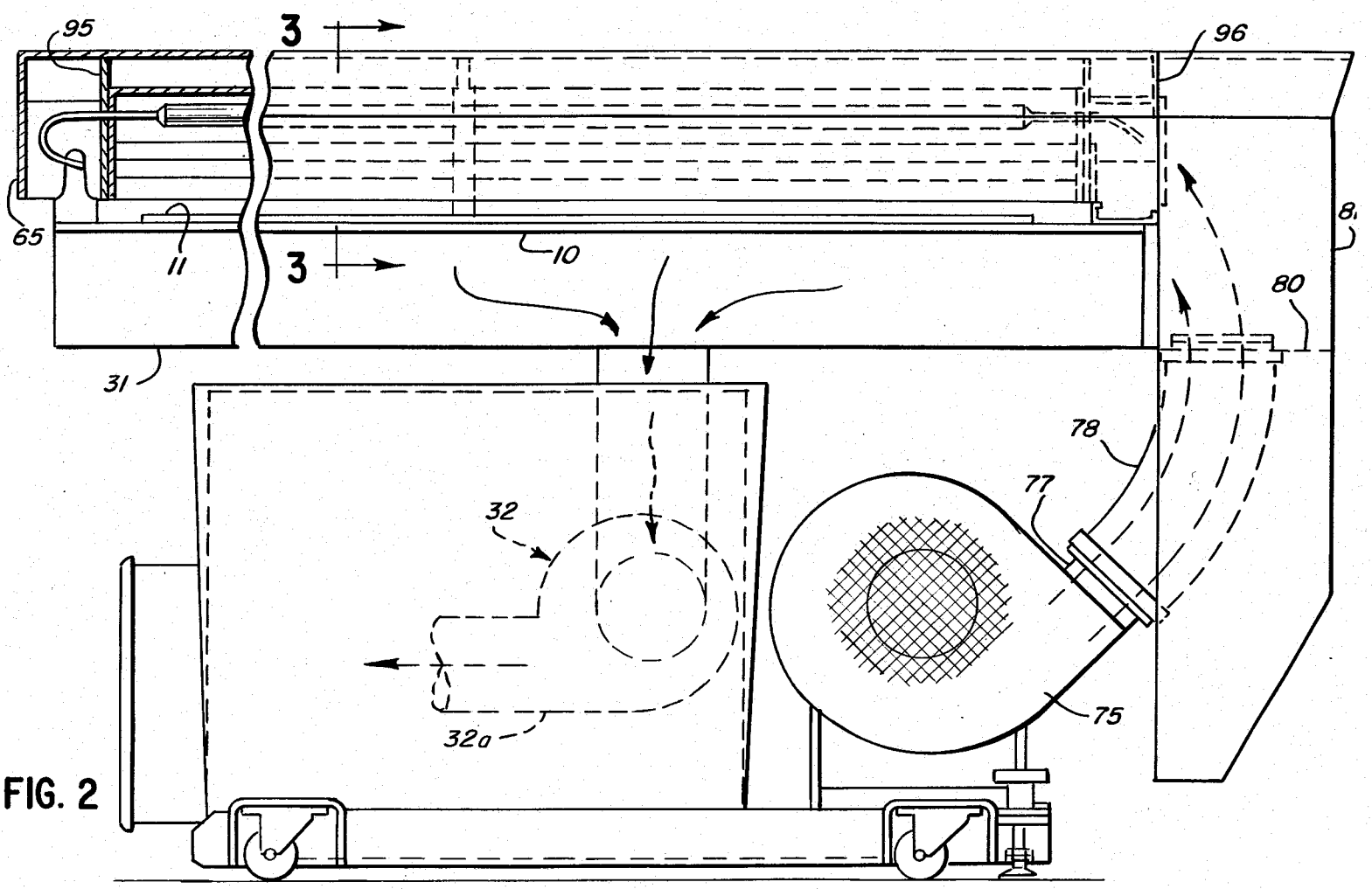
FIG. 2 is a front elevational view partially cross sectional.

From the foregoing it will be seen that in operation, the sheets 11 are mounted on the conveyor belt 10 with their upper surfaces 19 facing upwardly to pass beneath the light shield 22 at the inlet end 12 of the apparatus for travel through a short distance to an irradiating chamber at which is located the irradiating UV lamp 16. The sheets are heated to a high temperature, for example, at least 180° to 200° F. by the lamps. However, in the present invention, the temperature of the sheets is reduced very substantially in inexpensive and very quick manner by a high velocity air means which comprises a series of air knives 55 each of which converts high pressure, low velocity room air into high velocity, lower pressure jets of air each impinging against the upper surface of the sheet. The sheet thus is carried across a plurality of discrete discharging air jets at spaced intervals with each of the air jets delivering air at a velocity above the Reynolds number, e.g., at 1000 fpm, to produce highly turbulent air flow at **56*a*, 56*b* and 56*c* across the surface of the sheet to aid in quickly removing heat from the surface of the sheet and from the ink. The sheets would tend to lift and fly and flutter because of the reduced air pressure on their top surfaces from the air flow thereacross. However, the sheets are held flat and against the conveyor belt by suction from the suction box 31 located below the mesh conveyor belt. The conveyor belt carries the sheets from the apparatus and beneath the outlet light shield brush 100. Thus, the sheets are held on to the conveyor and any ozone or other harmful vapors are pulled across the air pervious belt 10 into the underlying suction box 31 and discharged from the suction blower 32 through its outlet 32*a* (FIG. 2**).

From the foregoing, it will be seen that the present invention provides an inexpensive apparatus which not only cures ink by UV light but also quickly and inexpensively cools the same with ambient room air. A common blower may be used to generate high velocity air jets to cool the sheets and to cool the reflector and UV lamp unit. An underlying suction box and air pervous conveyor provide suction to hold the sheets flat onto the conveyor despite the high velocity air flow across the top surface of the sheets.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. An apparatus for conveying a substrate through a UV radiation station for irradiating ink on the substrate and for cooling the irradiated substrate, said apparatus comprising:

an air pervious conveyor for conveying substrates along a predetermined path of travel, a housing over the air pervious conveyor having a UV curing station immediately adjacent an inlet to the housing, UV lamps means at the UV curing station including a reflector and UV lamp to irradiate the printed ink on the upper surface of the substrates being carried on the conveyor through the UV curing means, a substrate cooling means in said housing immediately downstream of the UV curing station to cool the substrates having past through the UV curing station, air cooling means including a plurality of air knives located at said substrate cooling means and each knive delivering a jet of air against the surface of the substrate to substantially lower the temperature of the substrate passing the air knives, a blower means for blowing air into said housing and across the reflector to cool the same, said blower means blowing air to said air knives for flowing air through the air knives to increase its velocity and to cause turbulent air flow across the surface of the substrate, and suction means including a suction box extending beneath the air pervious conveyor and beneath the UV curing means and the substrate cooling station for holding the substrate on the conveyor against fluttering because of the air flowing thereacross at both the UV curing station and the cooling station.

2. An apparatus in accordance with claim 1 in which said suction means comprises a blower connected to said suction box at its inlet to withdraw air from the suction box.

3. An apparatus in accordance with claim 1 in which said blower means is located beneath the conveyor, said housing extends transversely across said conveyor, and an air conduit extends from the blower means alongside the conveyor and upwardly to the housing to direct air discharging from said air conduit in a direction to flow transversely across the conveyor.

4. A method of conveying a substrate through a UV radiation station for irradiating ink on the substrate and for cooling the irradiated substrate, said method comprising the steps of:

conveying substrates along a predetermined path of travel on an air pervious conveyor and into a housing inlet, irradiating the substrates with UV radiation at a UV curing means immediately adjacent the inlet to the housing, irradiating the printed ink on the upper surface of the substrates being carried on the conveyor through the UV curing station for a short period of time to significantly raise the temperature of the ink while minimizing the raising of the temperature of the substrate, carrying the irradiated substrates to an immediately adjacent and downstream to substrate cooling means in said housing, flowing cooling air through a plurality of air knives located at said substrate cooling means with each knife delivering a jet of air against the surface of the substrate to substantially lower the temperature of the substrate passing the air knives, blowing air from a blower means into said housing and across the reflector to cool the same, flowing air through the air knives to increase its velocity and to cause turbulent air flow across the surface of the substrate, flowing air downwardly from the housing into and through a suction means extending beneath the air pervious conveyor and beneath the UV curing station and the substrate cooling means for holding the substrates on the conveyor against fluttering because of the air flowing thereacross at both the UV curing station and the cooling means.

5. A method in accordance with claim 4 including the steps of blowing the air upwardly from beneath the conveyor to the housing on one side thereof and then transversely across the conveyor and then downwardly through the air pervious conveyor and through the suction means for discharge.

* * * * *